US008821174B2

(12) United States Patent
Kimura et al.

(10) Patent No.: US 8,821,174 B2
(45) Date of Patent: Sep. 2, 2014

(54) FLOATING CONNECTOR SMALL IN SIZE AND IMPROVED IN STRENGTH

(75) Inventors: Masaki Kimura, Tokyo (JP); Yuichi Takenaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 17 days.

(21) Appl. No.: 13/482,293

(22) Filed: May 29, 2012

(65) Prior Publication Data

US 2013/0017729 A1 Jan. 17, 2013

(30) Foreign Application Priority Data

Jul. 14, 2011 (JP) ..... 2011-155723

(51) Int. Cl.
*H01R 13/64* (2006.01)

(52) U.S. Cl.
USPC ..... 439/248; 439/567; 439/570

(58) Field of Classification Search
USPC ..... 439/247, 248, 660, 567, 570
See application file for complete search history.

(56) References Cited

U.S. PATENT DOCUMENTS

| | | | | |
|---|---|---|---|---|
| 6,039,590 | A * | 3/2000 | Kunishi | 439/247 |
| 6,435,905 | B1 * | 8/2002 | Yu et al. | 439/567 |
| 7,186,126 | B2 * | 3/2007 | Umehara et al. | 439/247 |
| 7,704,089 | B2 * | 4/2010 | Tseng | 439/248 |
| 7,878,829 | B2 * | 2/2011 | Yang et al. | 439/247 |
| 7,887,350 | B2 * | 2/2011 | Fukazawa et al. | 439/247 |
| 7,892,001 | B2 * | 2/2011 | Hanyu | 439/247 |
| 8,100,706 | B2 * | 1/2012 | Matsuzawa et al. | 439/247 |
| 2006/0258199 | A1 | 11/2006 | Umehara et al. | |

FOREIGN PATENT DOCUMENTS

JP 2006/318763 11/2006

* cited by examiner

*Primary Examiner* — Hien Vu
(74) *Attorney, Agent, or Firm* — Collard & Roe, P.C.

(57) ABSTRACT

A floating connector has a stationary housing, a movable housing, and a reinforcing member. The reinforcing member is made of a metal plate and is provided with a first plate portion and a second plate portion. The first plate portion is embedded in a guide portion of the stationary housing so as to extend in a depth direction. The second plate portion is embedded in the guide portion so as to extend inward in a width direction from one end in the depth direction of the first plate portion.

8 Claims, 12 Drawing Sheets

FIG. 4B
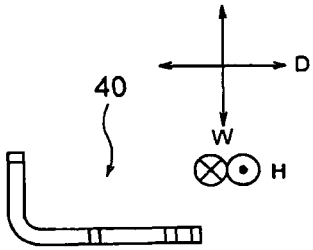
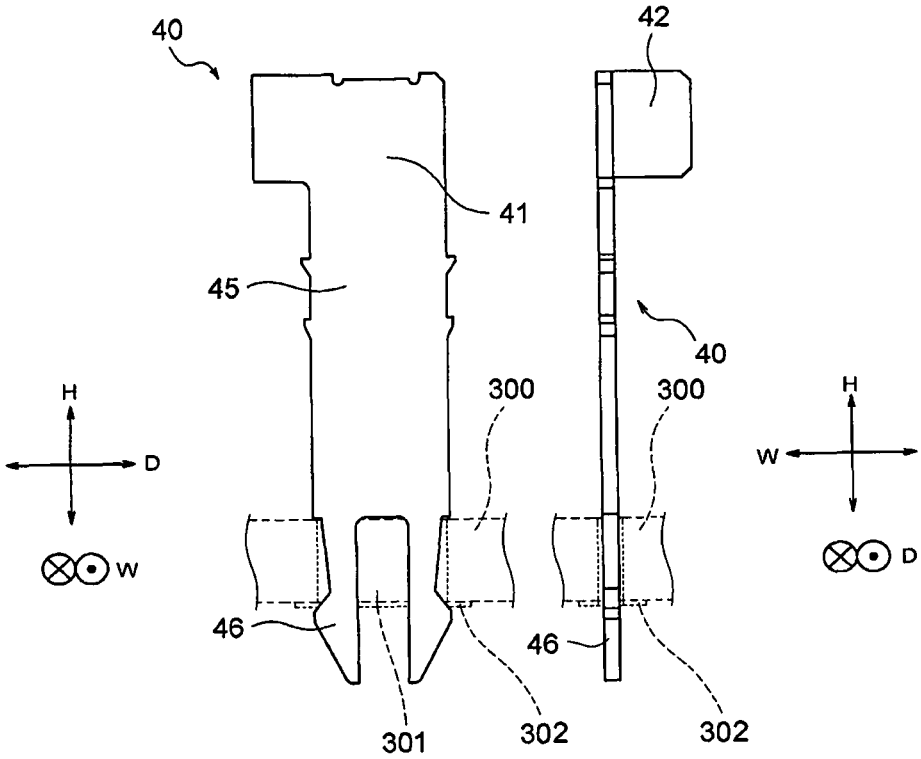
FIG. 4A FIG. 4C

FLOATING CONNECTOR SMALL IN SIZE AND IMPROVED IN STRENGTH

This application is based upon and claims the benefit of priority from Japanese Patent Application No. 2011-155723, filed on Jul. 14, 2011, the disclosure of which is incorporated herein in its entirety by reference.

BACKGROUND ART

This invention relates to an electrical connector and, in particular, relates to a floating connector in which a movable housing is floatingly coupled to a stationary housing.

With this type of floating connector, even if a mating connector is inserted in a state with some position offset, a movable housing floats according to the position of the mating connector to absorb the position offset, so that it is possible to achieve normal fitting and electrical connection.

For example, this type of floating connector is mounted on a board in the body of an electronic device such as a notebook personal computer and is used for fitting and electrical connection to a mating connector provided in a removable unit such as a disk drive which is removably attached to the electronic device.

This type of floating connector is disclosed in, for example, JP-A-2006-318763.

Referring to FIG. 11, a floating connector disclosed in this patent document has a depth direction D parallel to an insertion/removal direction of a mating connector (not illustrated) and width and height directions W and H which are respectively perpendicular to the depth direction D. This floating connector comprises a stationary housing 610 adapted to be fixed to a board (not illustrated) as a mounting object and a movable housing 620 which is coupled to the stationary housing 610 so as to be floatable in the height direction H through a plurality of flexible contacts 630 (only part of them are illustrated) held in parallel with each other in the width direction W.

The movable housing 620 has a guided portion (hole portion) 622.

On the other hand, the stationary housing 610 has a guide portion (columnar portion) 612 which guides floating of the movable housing 620 in the height direction H while limiting the position of the hole portion 622 in the width and depth directions W and D.

Herein, in this type of floating connector, as the number of contacts (the number of pins) increases, the width of a movable housing increases and thus its weight also increases to apply a greater load to a guide portion of a stationary housing. As a result, there is a possibility of the occurrence of a crack if the floating connector is used for a certain period of time. In order to prevent this, a resin with glass fibers may be used as a material of the stationary housing and the movable housing to ensure the strength of the housings.

In addition, in order to further strengthen the guide portion of the stationary housing, a reinforcing member may be provided at the guide portion of the stationary housing. For example, the floating connector shown in FIG. 11 has a reinforcing member (metal pin) 640 for reinforcing the guide portion 612 of the stationary housing 610. The reinforcing member 640 passes through the inside of the guide portion 612 in the height direction H.

When the floating connector is used for electrical connection to a mating connector provided in a removable unit such as a disk drive as described above, since the removable unit is normally large and heavy, it is expected that a very large load is applied to the guide portion of the stationary housing particularly in the depth direction when the mating connector is fitted to the floating connector.

Under these circumstances, since the reinforcing member is made of the metal pin in the conventional floating connector such as the one shown in FIG. 11, unless the diameter of the metal pin is considerably large, its strength cannot necessarily be said to be sufficient. However, increasing the diameter of the metal pin for ensuring sufficient strength leads to an increase in the size of the overall floating connector and thus further leads to an increase in the size of an electronic device using such a floating connector.

DISCLOSURE OF THE INVENTION

It is therefore an object of this invention to provide a floating connector which is sufficiently improved in strength with no increase in size.

According to an aspect of this invention, there is provided a floating connector adapted to be mounted on a mounting object. The floating connector comprises a stationary housing adapted to be fixed to the mounting object; and a movable housing held by the stationary housing so as to be floatable in width and height directions which are respectively perpendicular to a depth direction parallel to an insertion/removal direction of a mating connector. The movable housing is provided with a guided portion. The stationary housing is provided with a guide portion guiding floating of the movable housing while limiting a position of the guided portion in the depth direction. The floating connector further comprises a reinforcing member reinforcing the stationary housing which includes the guide portion. The reinforcing member is made of a metal plate and is provided with a first plate portion and a second plate portion. The first plate portion is embedded in the guide portion so as to extend in the depth direction. The second plate portion is embedded in the guide portion so as to extend inward in the width direction from one end in the depth direction of the first plate portion.

According to another aspect of this invention, there is provided a connector system (100) comprising the floating connector (1) and the mating connector (200) mentioned above. (For example, the connector system (100) is shown in FIGS. 5 and 6.)

BRIEF DESCRIPTION OF THE DRAWINGS

FIGS. 4A, 4B and 4C are respectively a front view, a plan view and a side view of a reinforcing member (for the right side) in the floating connector shown in FIG. 1.

DETAILED DESCRIPTION OF THE PREFERRED EMBODIMENTS

Figure 1:
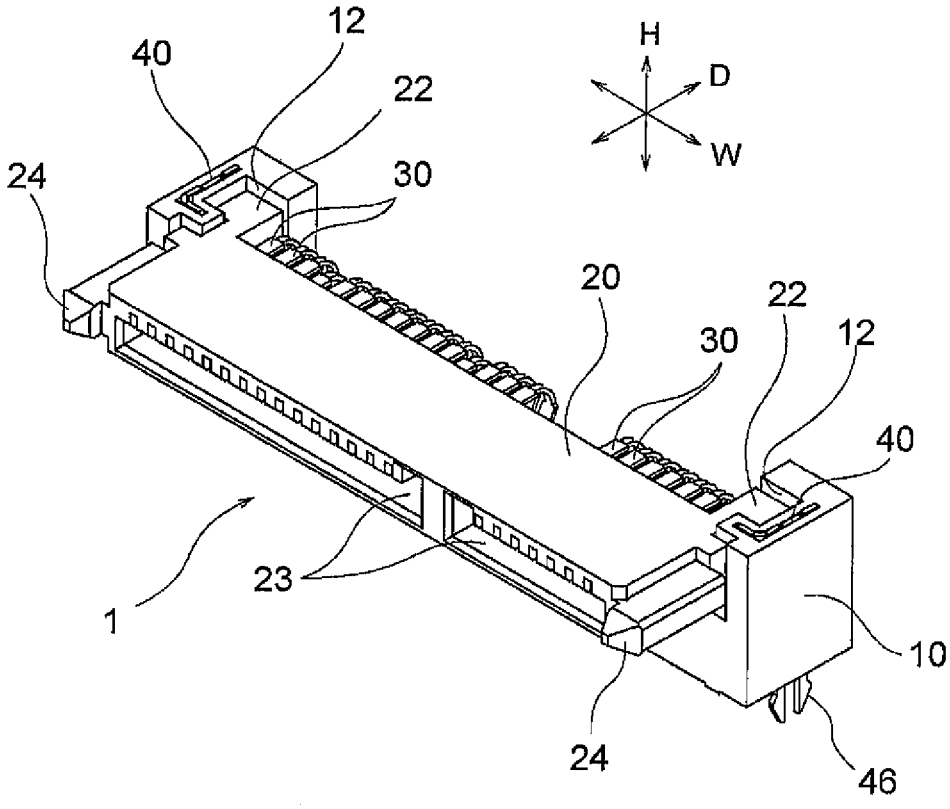
FIG. 1 is a perspective view showing a floating connector according to a first embodiment of this invention.

A floating connector according to this invention has a depth direction parallel to an insertion/removal direction of a mating connector and width and height directions which are respectively perpendicular to the depth direction. The floating connector comprises a stationary housing and a movable housing. The stationary housing is adapted to be fixed to a mounting object. The movable housing is held by the stationary housing so as to be floatable in the height and width directions through a plurality of flexible contacts held in parallel with each other in the width direction.

The movable housing has a guided portion. On the other hand, the stationary housing has a guide portion which guides floating of the movable housing while limiting the position of the guided portion in the depth direction, and further has a reinforcing member that reinforces the stationary housing including the guide portion.

In particular, in this floating connector, the reinforcing member is made of a metal plate and is provided with a plurality of plate portions, and is embedded in the guide portion.

With this structure, the floating connector is sufficiently improved in strength with no increase in size.

Hereinbelow, specific embodiments of this invention will be described with reference to the drawings.

First Embodiment

Referring to FIGS. 1 to 6, a floating connector 1 according to a first embodiment of this invention is configured to be mounted on a board 300 (shown in FIGS. 2D, 4A and 4C) as a mounting object having a plate shape in an electronic device such as a notebook personal computer and to have a depth direction D parallel to an insertion/removal direction of a mating connector 200 provided in a removable unit (not illustrated) such as an optical disk drive which is removably attached to the electronic device, and width and height directions W and H which are respectively perpendicular to the depth direction D.

The floating connector 1 comprises a stationary housing 10 and a movable housing 20 each made of a resin material. As this resin material, use is made of, for example, a resin material with glass fibers.

The stationary housing 10 is adapted to be fixed so that its mounting surface 13 (FIG. 2D) is disposed on a mounting surface of the board in the electronic device.

On the other hand, the movable housing 20 is held by the stationary housing 10 so as to be floatable in the height direction H through a plurality of flexible contacts 30 held in parallel with each other in the width direction W.

The movable housing 20 is also floatable in the depth and width directions D and W corresponding to a clearance provided when the movable housing 20 and the stationary housing 10 are assembled together.

Figure 2A:
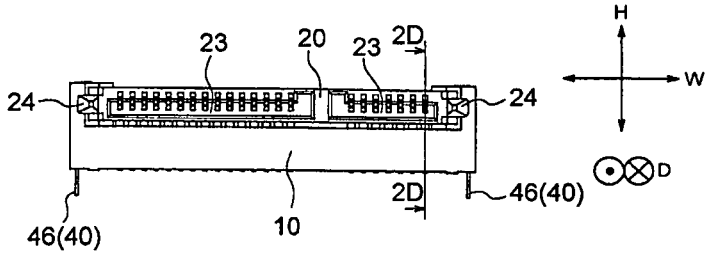
FIGS. 2A, 2B and 2C, and 2D are respectively a front view, a plan view, and a side view of the floating connector shown in FIG. 1, and an enlarged cross-sectional view taken along line 2D-2D of FIG. 2A.
Figure 2B:
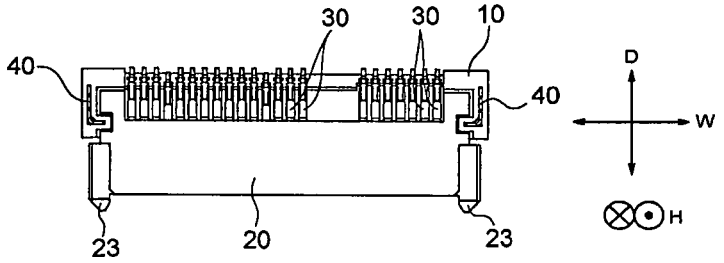
Figure 2C:
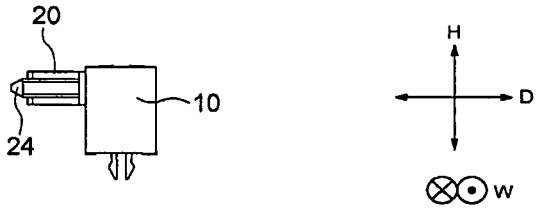
Figure 2D:
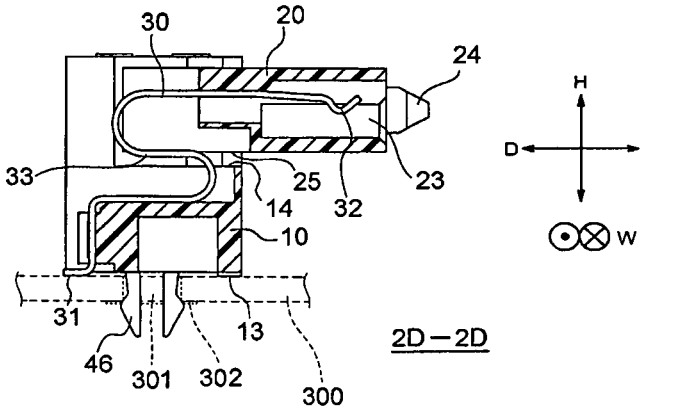

As shown in FIG. 2D, each contact 30 has a terminal portion 31 adapted to be soldered to a corresponding one of lands (not illustrated) formed on the mounting surface of the board, a contact portion 32 adapted to be electrically connected to a corresponding one of contacts of the mating connector 200 when the mating connector 200 is fitted to the floating connector 1 (see FIG. 6), and an intermediate portion 33 extending in an S-shape in cross section between the terminal portion 31 and the contact portion 32 to serve as a spring.

On the front side in the depth direction D, the movable housing 20 has insertion guide portions 24 at its both ends in the width direction W. Each insertion guide portion 24 is formed corresponding to a recess (not illustrated) formed at a forward end in the insertion or fitting direction of the mating connector 200 and protrudes so as to be tapered for guiding the fitting of the mating connector 200. The movable housing 20 is formed with fitting recesses 23 which are respectively adapted to receive therein front portions of the mating connector 200 at the time of its fitting. As shown in FIG. 2D, the contact portions 32 of the contacts 30 are exposed in the fitting recesses 23 so as to be brought into contact with the contacts of the mating connector 200 at the time of its fitting.

Further, the movable housing 20 has guided portions 22 at its both ends in the width direction W. Each guided portion 22 has a rectangular convex shape and protrudes outward. On the other hand, the stationary housing 10 has guide portions 12 at its both ends in the width direction W. Each guide portion 12 has a rectangular concave shape and is open inward corresponding to the protruding guided portion 22. The guide portions 12 serve to guide floating of the movable housing 20 in the height direction H while limiting the position of the guided portions 22 in the depth and width directions D and W.

Further, the stationary housing 10 has reinforcing members 40 that serve to reinforce the stationary housing 10 including the guide portions 12.

Figure 3:
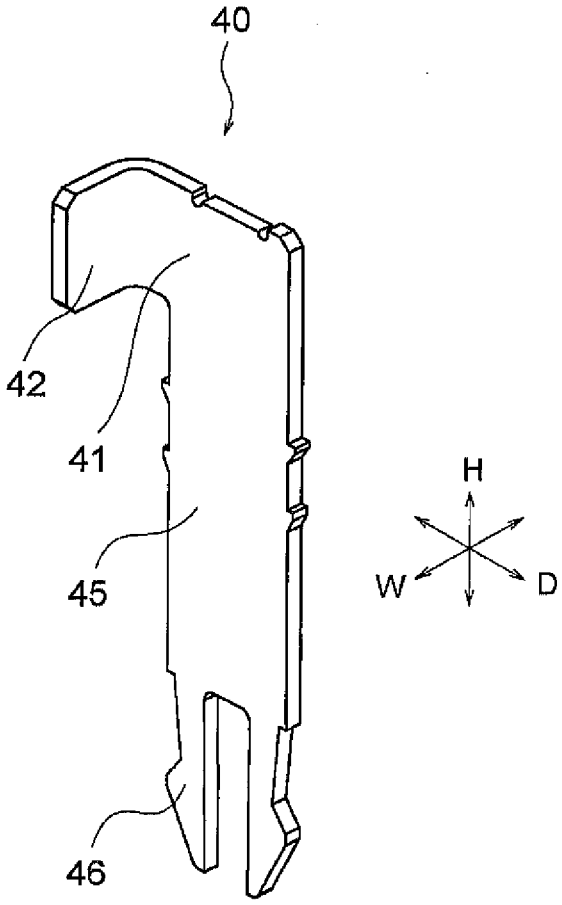
FIG. 3 is a perspective view showing a reinforcing member (for the left side) in the floating connector shown in FIG. 1.
Figure 5:
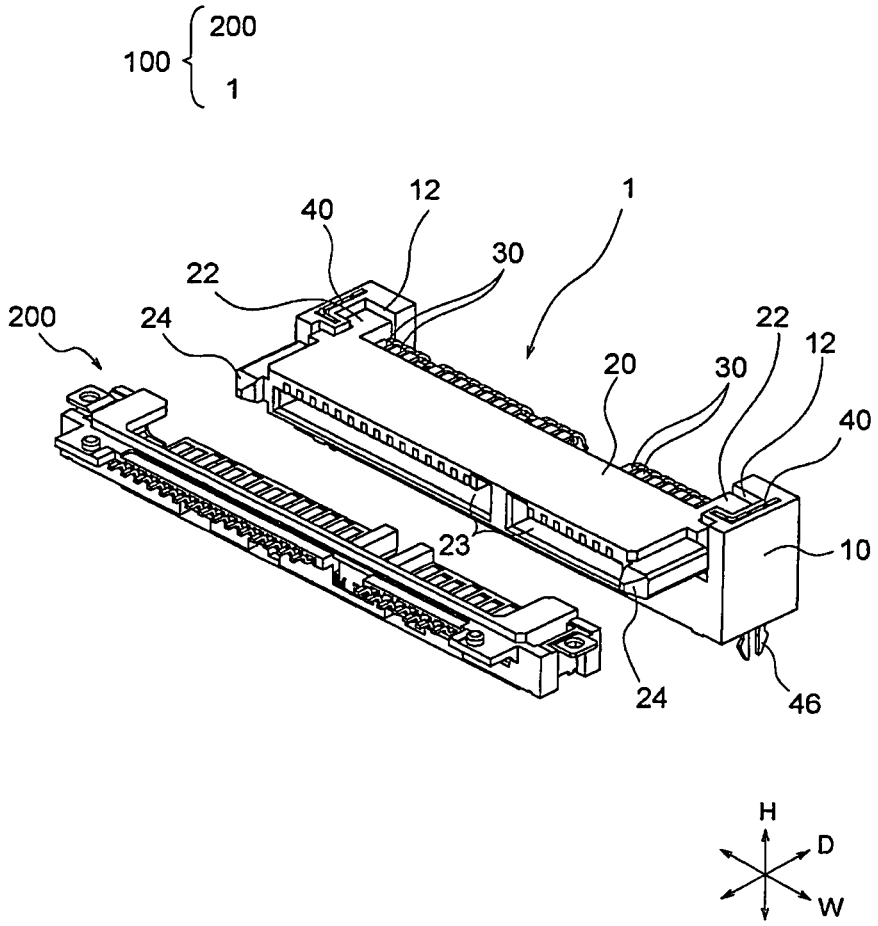
FIG. 5 is a perspective view showing a state before a mating connector is fitted to the floating connector shown in FIG. 1.
Figure 6:
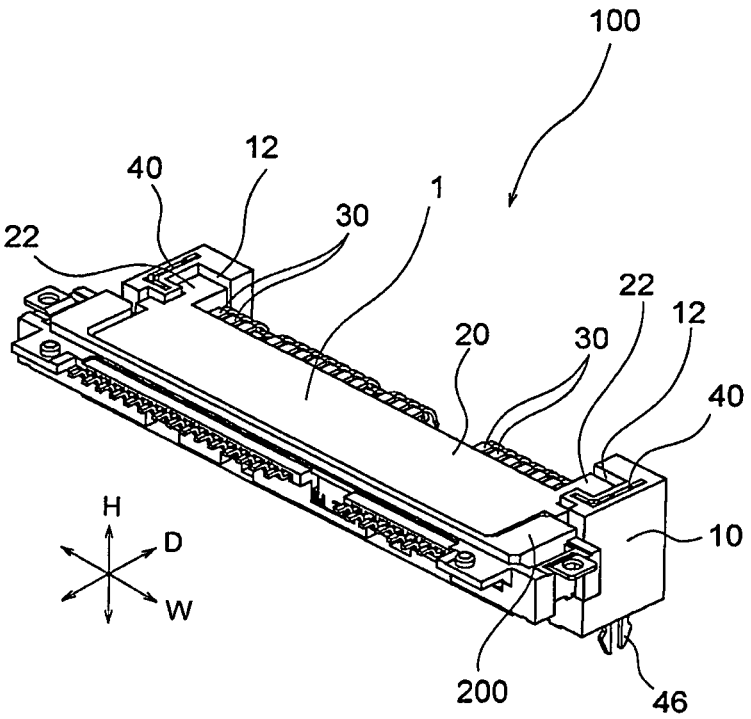
FIG. 6 is a perspective view showing a state where the mating connector is fitted to the floating connector shown in FIG. 1.

Each reinforcing member 40 is formed from a metal plate by press working including punching and bending and, as shown in FIG. 3 and FIGS. 4A to 4C, is provided with a first plate portion 41 and a second plate portion 42. The reinforcing member 40 is further provided with an end portion (a fixed portion) 46, which will be described in detail later, and an intermediate portion 45 extending between the first plate portion 41 and the end portion 46. FIG. 3 shows a perspective view of the reinforcing member 40 for the left side in the width direction W of the floating connector 1, while FIGS. 4A to 4C show three orthographic views of the reinforcing member 40 for the right side in the width direction W of the floating connector 1.

The first and second plate portions 41 and 42 and the intermediate portion 45 of each reinforcing member 40 are embedded in the guide portion 12 of the stationary housing 10 by, for example, press fitting. The reinforcing members 40 may be embedded in the guide portions 12 of the stationary housing 10 by insert molding.

In each reinforcing member 40 embedded in the guide portion 12, the first plate portion 41 extends in the depth direction D. On the other hand, the second plate portion 42 extends inward in the width direction W from a front end in the depth direction D of the first plate portion 41. That is, the first and second plate portions 41 and 42 are embedded in the guide portion 12 so as to form an L-shape in plan view surrounding the guided portion 22. In this invention, the second plate portion may extend inward in the width direction from a rear end in the depth direction of the first plate portion.

By providing such a reinforcing member 40, the floating connector 1 can achieve an improvement in strength, equal to or close to that which is achieved when a rectangular prism shaped reinforcing member having a cross-section of "(length in the depth direction D of the first plate portion 41) X (length in the width direction W of the second plate portion 42)" is embedded, for the guide portion 12 of the stationary housing 10 which relatively concentratedly receives a load due to floating of the movable housing 20 and a large load which is applied particularly in the depth direction D when the mating connector 200 is fitted to the floating connector 1 in the case where the use of the floating connector 1 is for electrical connection to the mating connector 200 provided in the removable unit. On the other hand, since the reinforcing member 40 is made of the metal plate and has the shape that extends in the L-shape along the guided portion 22 when embedded in the guide portion 12, the reinforcing member 40 is disposed in a space saving manner without occupying a useless space and, therefore, it is possible to prevent an increase in the size of the floating connector 1 and thus to prevent an increase in the size of the electronic device to which the floating connector 1 is applied. Accordingly, the floating connector 1 is sufficiently improved in strength with no increase in size.

The improvement in strength can be achieved regardless of whether the second plate portion extends inward in the width direction from the front or rear end in the depth direction of the first plate portion. Still, when it is configured that the second plate portion extends from the rear end in the depth direction of the first plate portion, the improvement in strength is achieved particularly with respect to a load at the time of insertion of the mating connector. On the other hand, when it is configured that the second plate portion extends from the front end in the depth direction of the first plate portion, the improvement in strength is achieved particularly with respect to a load at the time of removal of the mating connector.

As shown in FIG. 2D, the reinforcing member 40 has the end portion 46 protruding from a lower surface in the height direction H of the stationary housing 10. Furthermore, as shown in FIGS. 2D, 4A, 4C and 12B, the reinforcing member 40 is adapted to pass through a slit 301 which is formed through the board 300 as the mounting object in the electronic device. The end portion 46 passing through the slit 301 of the board 300 is soldered to at least a land pattern 302) which is formed around the slit 301 on a surface, on the opposite side of the mounting surface, of the board 300.

By soldering the end portion 46 to the board 300, the mounting strength of the stationary housing 10 of the floating connector 1 to the board 300 is significantly improved with respect to a load due to floating of the movable housing 20 and a large load which is applied particularly in the depth direction D when the mating connector 200 is fitted to the floating connector 1 in the case where the use of the floating connector 1 is for electrical connection to the mating connector 200 provided in the removable unit.

As shown in FIGS. 2D, 4A, 12A and 12B, the end portion 46 has a forked wedge shape. With this configuration, in a process of mounting the floating connector 1 on the board 300, the end portion 46 is easily inserted into the slit 301 of the board 300 and, after the insertion, the end portion 46 serves to provide temporary fixation to prevent the floating connector 1 from coming off the board 300 until the end portion 46 is soldered to the board 300.

Second Embodiment

In a floating connector 1' according to a second embodiment of this invention, only the shape of a reinforcing member differs from that in the first embodiment. Accordingly, with respect to the structures and operations which are the same as or similar to those in the first embodiment, the drawings and description of the first embodiment will be referred to, thereby omitting a detailed description thereof hereinbelow.

Figure 7:
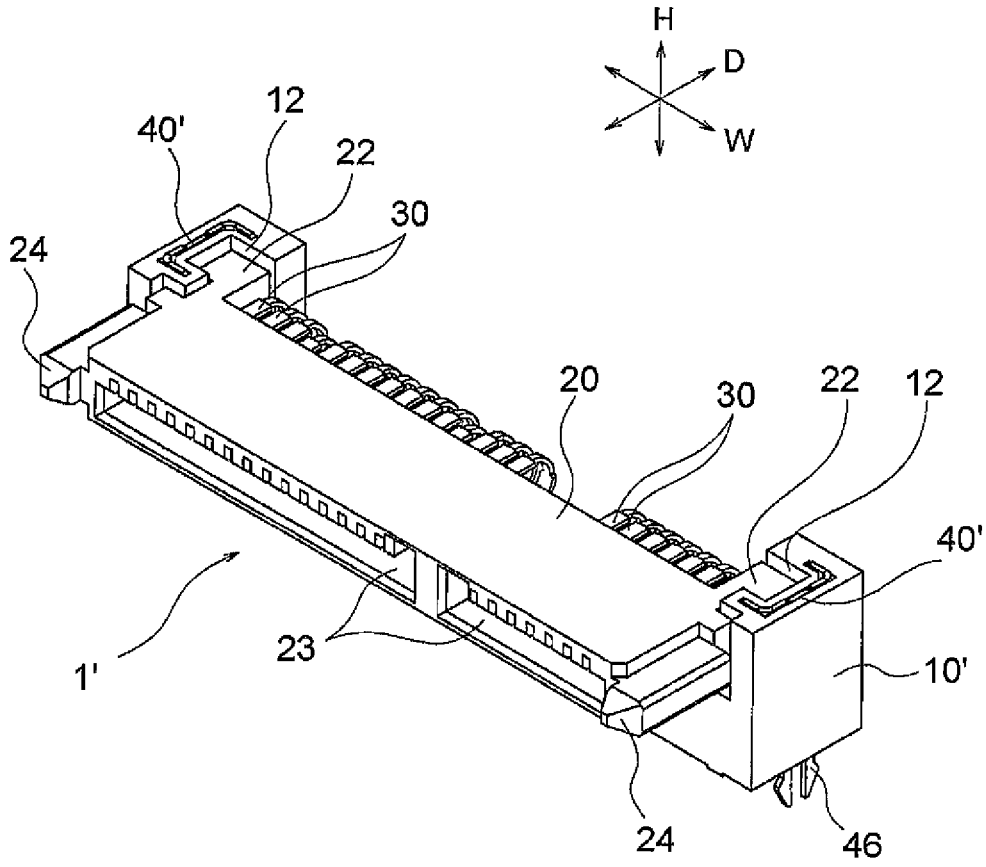
FIG. 7 is a perspective view showing a floating connector according to a second embodiment of this invention.

Referring to FIG. 7, the floating connector 1' according to the second embodiment of this invention is configured to be mounted on a board (not illustrated) in an electronic device such as a notebook personal computer and to have a depth direction D parallel to an insertion/removal direction of a mating connector provided in a removable unit (not illustrated) such as an optical disk drive which is removably attached to the electronic device, and width and height directions W and H which are respectively perpendicular to the depth direction D.

The floating connector 1' comprises a stationary housing 10' and a movable housing 20 each made of a resin material with glass fibers like in the first embodiment.

The movable housing 20 is held by the stationary housing 10' so as to be floatable in the height direction H through a plurality of flexible contacts 30 held in parallel with each other in the width direction W.

The movable housing 20 has guided portions 22 at its both ends in the width direction W. Each guided portion 22 has a rectangular convex shape and protrudes outward. On the other hand, the stationary housing 10' has guide portions 12 at its both ends in the width direction W. Each guide portion 12 has a rectangular concave shape and is open inward corresponding to the protruding guided portion 22. The guide portions 12 serve to guide floating of the movable housing 20 in the height direction H while limiting the position of the guided portions 22 in the depth and width directions D and W.

Further, the stationary housing 10' has reinforcing members 40' that serve to reinforce the stationary housing 10' including the guide portions 12.

Figure 8:
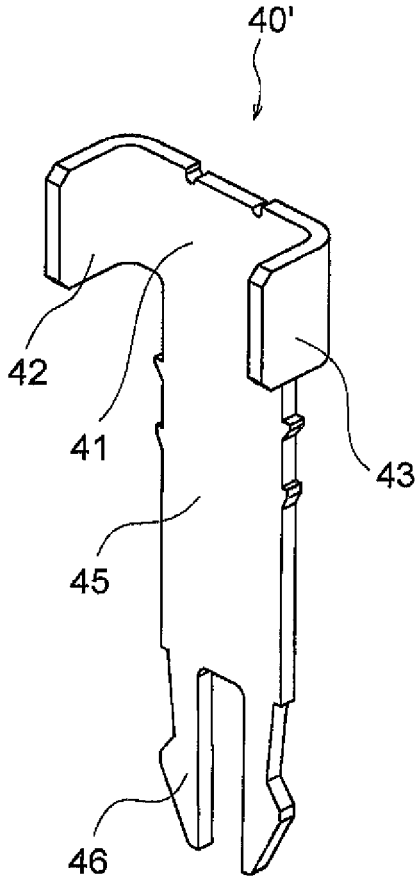
FIG. 8 is a perspective view showing a reinforcing member in the floating connector shown in FIG. 7.

Each reinforcing member 40' is formed from a metal plate by press working including punching and bending and, as shown in FIG. 8, is provided with a first plate portion 41, a second plate portion 42, a third plate portion 43, a fixed portion 46, and an intermediate portion 45.

The first, second, and third plate portions 41, 42, and 43 and the intermediate portion 45 of each reinforcing member 40' are embedded in the guide portion 12 of the stationary housing 10' by, for example, press fitting. The reinforcing members 40' may be embedded in the guide portions 12 of the stationary housing 10' by insert molding.

In each reinforcing member 40' embedded in the guide portion 12, the first plate portion 41 extends in the depth direction D. On the other hand, the second plate portion 42 extends inward in the width direction W from a front end in the depth direction D of the first plate portion 41. Further, the third plate portion 43 extends inward in the width direction W, like the second plate portion 42, from a rear end in the depth direction D of the first plate portion 41. That is, the first, second, and third plate portions 41, 42, and 43 are embedded in the guide portion 12 so as to form a ]-shape in plan view surrounding the guided portion 22.

By providing the reinforcing members 40' described above, the floating connector 1' is further improved in strength for the stationary housing 10' including the guide portions 12 as compared with the floating connector 1 of the first embodiment having the L-shaped (in plan view) reinforcing members 40.

In the first embodiment, it is necessary to prepare different components having symmetrical shapes as the reinforcing members 40 that are respectively embedded in the guide portions 12 provided on the left and right sides in the width direction W while, in the second embodiment, it is sufficient to prepare components of the same kind (common components) having the same size and shape as the reinforcing members 40' for the left and right guide portions 12, which is thus suitable for mass production.

Third Embodiment

In a floating connector 1" according to a third embodiment of this invention, only the shape of a reinforcing member differs from those in the first and second embodiments. Accordingly, with respect to the structures and operations which are the same as or similar to those in the first and second embodiments, the drawings and description of the first and second embodiments will be referred to, thereby omitting a detailed description thereof hereinbelow.

Figure 9:
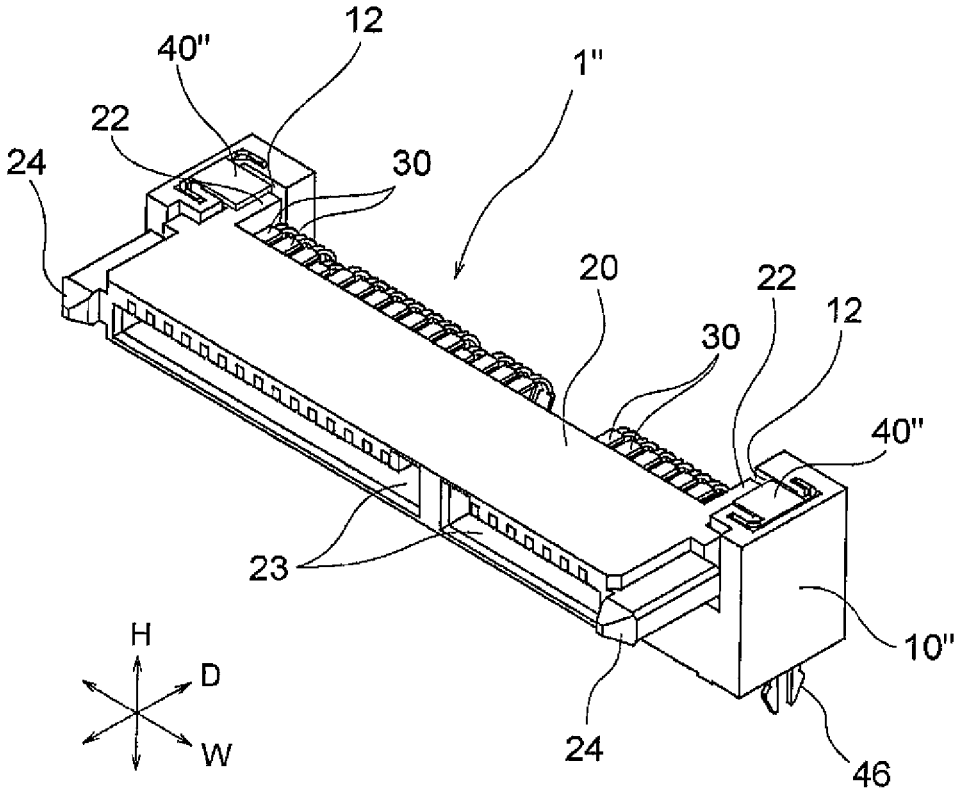
FIG. 9 is a perspective view showing a floating connector according to a third embodiment of this invention.

Referring to FIG. 9, the floating connector 1" according to the third embodiment of this invention is configured to be mounted on a board (not illustrated) in an electronic device such as a notebook personal computer and to have a depth direction D parallel to an insertion/removal direction of a mating connector provided in a removable unit (not illustrated) such as an optical disk drive which is removably attached to the electronic device, and width and height directions W and H which are respectively perpendicular to the depth direction D.

The floating connector 1" comprises a stationary housing 10" and a movable housing 20 each made of a resin material with glass fibers like in the first and second embodiments.

The movable housing 20 is held by the stationary housing 10" so as to be floatable in the height direction H through a plurality of flexible contacts 30 held in parallel with each other in the width direction W.

The movable housing 20 has guided portions 22 at its both ends in the width direction W. Each guided portion 22 has a rectangular convex shape and protrudes outward. On the other hand, the stationary housing 10" has guide portions 12 at its both ends in the width direction W. Each guide portion 12 has a rectangular concave shape and is open inward corresponding to the protruding guided portion 22. The guide portions 12 serve to guide floating of the movable housing 20 in the height direction H while limiting the position of the guided portions 22 in the depth and width directions D and W.

Further, the stationary housing 10" has reinforcing members 40" that serve to reinforce the stationary housing 10" including the guide portions 12.

Figure 10:
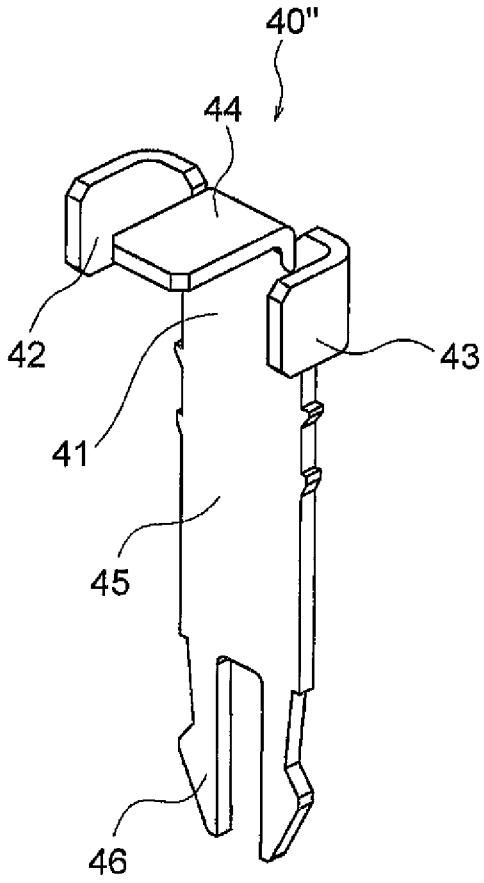
FIG. 10 is a perspective view showing a reinforcing member in the floating connector shown in FIG. 9.
Figure 11:
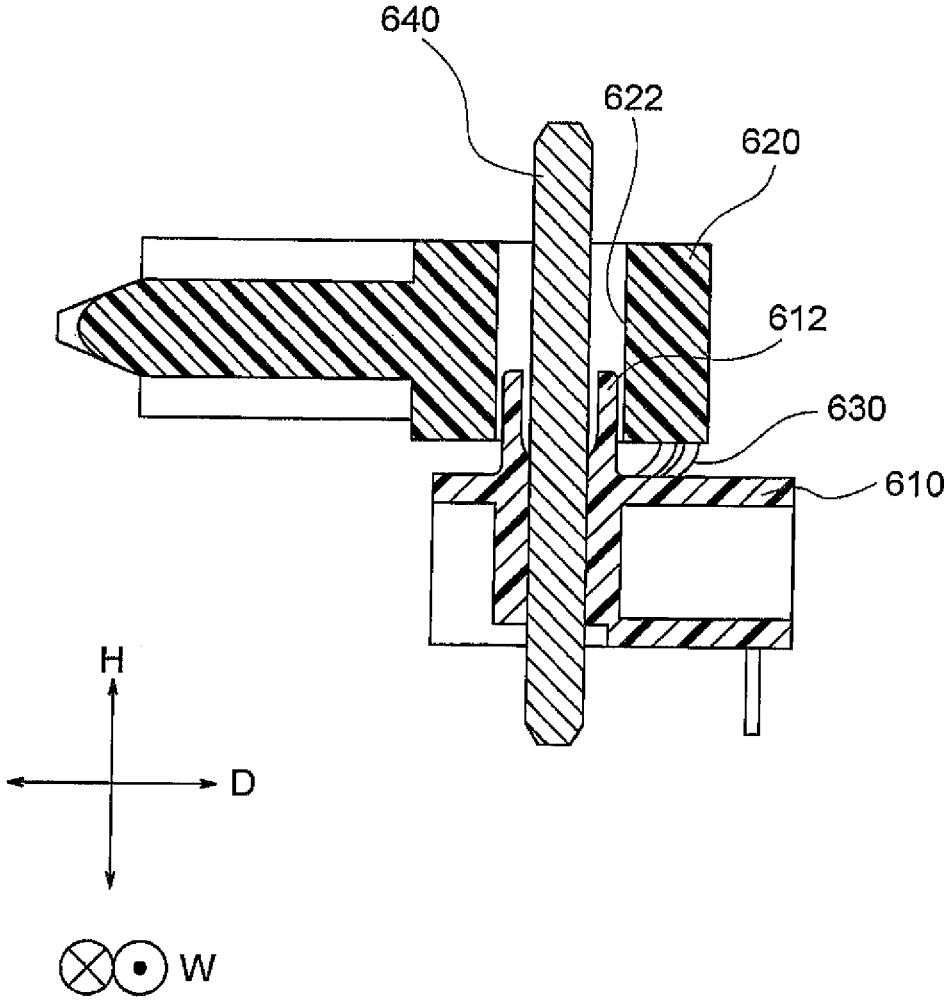
FIG. 11 is a cross-sectional view showing a floating connector as a related art of this invention.
Figure 12A:
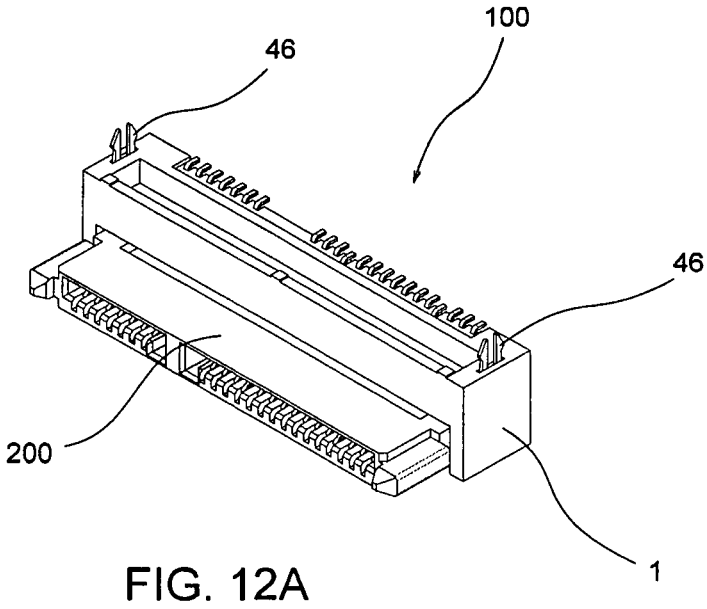
FIG. 12A is a perspective view showing a state where a Mating connector is fitted to the floating connector shown in FIG. 1 before the floating connector is mounted on a board
Figure 12B:
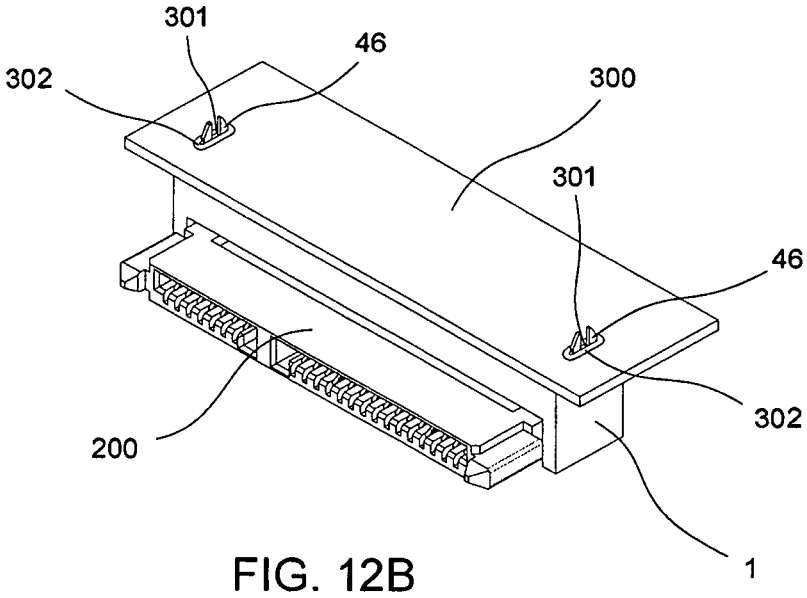
FIG 12B is a perspective view showing a state where the mating connector is fitted to the floating connector shown in FIG. 1 and the floating connector is mounted on the board.

Each reinforcing member 40" is formed from a metal plate by press working including punching and bending and, as shown in FIG. 10, is provided with a first plate portion 41, a second plate portion 42, a third plate portion 43, a fourth plate portion 44, a fixed portion 46, and an intermediate portion 45.

The first, second, and third plate portions 41, 42, and 43 and the intermediate portion 45 of each reinforcing member 40" are embedded in the guide portion 12 of the stationary housing 10" by, for example, press fitting. The reinforcing members 40" may be embedded in the guide portions 12 of the stationary housing 10" by insert molding.

In each reinforcing member 40" embedded in the guide portion 12, the first plate portion 41 extends in the depth direction D. On the other hand, the second plate portion 42 extends inward in the width direction W from a front end in the depth direction D of the first plate portion 41. Further, the third plate portion 43 extends inward in the width direction W, like the second plate portion 42, from a rear end in the depth direction D of the first plate portion 41. That is, the first, second, and third plate portions 41, 42, and 43 are embedded in the guide portion 12 so as to form a ]-shape in plan view surrounding the guided portion 22.

The fourth plate portion 44 extends inward in the width direction W from an upper end in the height direction H of the first plate portion 41. The fourth plate portion 44 is located over the guided portion 22.

By providing the reinforcing members 40" described above, the floating connector 1" is further improved in strength for the stationary housing 10" including the guide portions 12 as compared with the floating connector 1 of the first embodiment having the L-shaped (in plan view) reinforcing members 40.

Further, in the floating connector 1" of the third embodiment, since each reinforcing member 40" has the fourth plate portion 44 that serves as a canopy or a limiter, excessive upward displacement of the movable housing 20 is prevented when the movable housing 20 floats in the height direction H. With this configuration, it is possible to prevent deformation of the contacts 30 as support means for the movable housing 20 and to prevent damage to embedded portions of the contacts 30 in the stationary housing 10" and the movable housing 20 and damage to soldered portions of the contacts 30 on the board of the electronic device, which may otherwise occur if the movable housing 20 is excessively displaced upward. On the other hand, as is seen by referring to, for example, FIG. 2D of the first embodiment, excessive downward displacement of the movable housing 20 is prevented by abutment of a lower surface 25 of the movable housing 20 against a main surface 14 of a receiving portion, receiving therein the movable housing 20, of the stationary housing 10 (regarding the stationary housing 10 as the stationary housing 10").

In the third embodiment, the reinforcing member 40" has the structure in which the fourth plate portion is added to the ]-shaped (in plan view) reinforcing member 40' of the second embodiment. In this invention, a reinforcing member may alternatively have a structure in which the fourth plate portion is added to the L-shaped (in plan view) reinforcing member 40 of the first embodiment.

In the above-mentioned first to third embodiments, the reinforcing member has the structure in which the flat second plate portion or the flat second and third plate portions is/are bent at a substantially right angle from the flat first plate portion. However, in this invention, the shape of a reinforcing member is not limited to those of the embodiments as long as the reinforcing member is made of a metal plate and is provided with a first plate portion which is embedded in the guide portion so as to extend in the depth direction of the connector, and a second plate portion or second and third plate portions which is/are embedded in the guide portion so as to extend inward in the width direction from an end/ends in the depth direction of the first plate portion. That is, in the reinforcing member of this invention, the plate portions may be continuous with each other through a curved portion provided therebetween or each plate portion may have a curved shape rather than a flat shape.

In a connector system comprising the floating connector 1, 1', or 1" and the mating connector 200 adapted to be fitted thereto, even if the mating connector is inserted in a state with some position offset, the movable housing floats according to the position of the mating connector to absorb the position offset, so that it is possible to achieve normal fitting and electrical connection. In addition, since the floating connector, particularly the stationary housing including the guide portions, has sufficient strength, even if the mating connector along with the removable unit is inserted with a large insertion force, it is possible to reduce damage to the guide portions of the stationary housing and to the portions where the floating connector is mounted to the mounting object. Nevertheless, this connector system is small as a whole and thus can be mounted in a space saving manner, and therefore, it is possible to contribute to the miniaturization of the electronic device to which the floating connector is applied and of the removable unit to which the mating connector is applied.

It is needless to say that this invention is not limited to the above-mentioned embodiments and that various modifications can be made within the scope of this invention as defined by the claims.

What is claimed is:

1. A floating connector adapted to be mounted on a board, the floating connector comprising:

a stationary housing adapted to be fixed to the board; and a movable housing held by the stationary housing so as to be floatable in width and height directions which are respectively perpendicular to a depth direction parallel to an insertion/removal direction of a mating connector;

wherein the movable housing is provided with a guided portion;

wherein the stationary housing is provided with a guide portion guiding floating of the movable housing while limiting a position of the guided portion in the depth direction;

wherein the floating connector further comprises a reinforcing member positioned in a recess of the guide portion for reinforcing the stationary housing which includes the guide portion;

wherein the reinforcing member is made of a metal plate and is provided with a first plate portion and a second plate portion extending substantially perpendicular from the first plate portion;

wherein the first plate portion is embedded in the guide portion so as to extend in the depth direction;

wherein the second plate portion is embedded in the guide portion so as to extend inward in the width direction from one end in the depth direction of the first plate portion;

wherein the guide portion has a floatable range where the guided portion is floatable in the height direction; and wherein the first plate portion extends and is embedded in the guide portion so as to fully-cover the entire floatable range in the height direction.

2. The floating connector according to claim 1, wherein the reinforcing member is further provided with a third plate portion embedded in the guide portion so as to extend inward in the width direction from the other end in the depth direction of the first plate portion.

3. The floating connector according to claim 1, wherein the reinforcing member is further provided with a fourth plate portion extending inward in the width direction from an upper end in the height direction of the first plate portion, the fourth plate portion being located over the guided portion.

4. The floating connector according to claim 1, wherein the reinforcing member is further provided with an end portion protruding from a lower end in the height direction of the stationary housing, to be connected to the board.

5. The floating connector according to claim 4, wherein the end portion of the reinforcing member protrudes from the lower end in the height direction of the stationary housing, the end portion being adapted to pass through a hole, formed through the board, so as to be connected to a land pattern formed peripherally in the hole of the board.

6. The floating connector according to claim 1, wherein the movable housing is held by the stationary housing through a plurality of contacts, the contacts having flexibility and being held by the stationary housing in parallel with each other in the width direction.

7. The floating connector according to claim 1, wherein the movable housing is held by the stationary housing so as to be floatable in the depth direction.

8. A connector system comprising the floating connector according to claim 1 and the mating connector.

* * * * *